United States Patent [19]

Goff et al.

[11] 4,381,105

[45] Apr. 26, 1983

[54] CLAMP

[75] Inventors: Otis W. Goff, Kalamazoo; Melvin J. Goff, Wyoming, both of Mich.

[73] Assignee: Gordon W. Hueschen, Kalamazoo, Mich.

[21] Appl. No.: 147,931

[22] Filed: May 8, 1980

[51] Int. Cl.[3] ..... B25B 1/02

[52] U.S. Cl. ..... 269/210; 269/235; 269/171

[58] Field of Search ..... 269/196, 200, 229, 230, 269/232, 235, 236, 171, 171.5, 210, 212–214, 207, 166; 24/263 B

[56] References Cited

U.S. PATENT DOCUMENTS

| | | | |
|---|---|---|---|
| 305,963 | 9/1884 | Richards | 269/171 |
| 399,926 | 3/1889 | Pollard | 269/210 |
| 881,530 | 3/1908 | Barker | 269/230 |
| 1,452,753 | 4/1923 | Otto et al. | 269/207 |
| 1,639,561 | 8/1927 | Hargrave | 269/171.5 |
| 2,095,037 | 10/1937 | Reintjes | 269/235 |
| 2,978,803 | 4/1961 | Davies | 269/235 |
| 4,078,781 | 3/1978 | Fraser et al. | 269/171 |

FOREIGN PATENT DOCUMENTS

| | | | |
|---|---|---|---|
| 1104909 | 4/1961 | Fed. Rep. of Germany | 269/236 |
| 1218592 | 12/1959 | France | 269/236 |
| 1342240 | 9/1962 | France | 269/171 |
| 14194 | 3/1897 | Switzerland | 269/171 |
| 788101 | 12/1957 | United Kingdom | 269/166 |
| 863441 | 3/1961 | United Kingdom | 269/171 |

*Primary Examiner*—Robert C. Watson

*Attorney, Agent, or Firm*—Gordon W. Hueschen

[57] ABSTRACT

There is disclosed a clamp which is particularly adapted for use in high-temperature applications in which arms bearing clamping faces are mounted on a flat bar in a manner such that they can be released to slide along the bar and clamped in any desired position. One arm has a fixed clamping face and the other arm has a movable clamping face movable toward the other. The latter is affixed to the free end of an elongate member adapted to reciprocate back and forth in the other arm and to be moved toward the first clamping face by a spiral cam. Means is provided for locking the arms to the backbone member and for locking the spiral cam in the clamping position.

2 Claims, 8 Drawing Figures

CLAMP

FIELD OF INVENTION AND PRIOR ART

This invention relates to a clamp and is particularly directed to a clamp useful for clamping workpieces under conditions of extremely high temperature.

Certain metals, for example, titanium, does not readily take a permanent set when formed in the cold. It is customary in these cases to clamp the metal between shaping or forming dies and to heat the entire assembly to the temperature necessary to effect a permanent set of the metal in the dies.

The usual 'C' clamps used for this purpose have a very short life as they become warped and distorted under the influence of the extremely high temperature necessary to effect the set.

OBJECTS OF THE INVENTION

It is an object of the invention to provide a new and improved clamp. It is a further objection of the invention to provide a clamp which is resistant to high temperatures. It is a further object of the invention to provide a clamp in which the clamp mechanism does not become distorted and unusable after exposure to high temperatures. It is a further object of the invention to provide a clamp having means for effecting adjustment of the space between the clamping faces which does not become distorted or unuseable after exposure to high temperatures. It is a further object of the invention to avoid the disadvantages of the prior art and to obtain such advantages as will appear as the description proceeds.

BRIEF DESCRIPTION OF THE INVENTION

The invention relates to a clamp the construction of which makes it suitable for repeated use at extremely high temperatures such as are encountered in the forming of certain metals, such as titanium, and is particularly directed to a clamp which comprises a base member; a clamping face on the base member; an elongate member mounted on the base member for reciprocation to and away from the clamping face; a second clamping face affixed to the end of the elongate member opposed to the first clamping face, which elongate member is mounted for reciprocation in a longitudinal axis running through the first clamping face; a spiral cam affixed to a transverse axle journaled in the base member in line with the longitudinal axis; a cam follower affixed to the other end of the elongate member adapted to be engaged by the spiral cam; tool engagement means on one end of the transverse axle so that it can be engaged by a rotating tool for causing rotation of the spiral cam; and, axle lock means on the other end of the transverse axle for locking it against rotation.

The axle lock means preferably comprises a longitudinal axle journaled in the base member and having an offset cam surface in position effective, on rotation of the longitudinal axis, to jam the transverse axle. Advantageously, the offset cam surface is machined in the longitudinal axle on a curvature complementary with the curvature of the transverse axle so that, when the offset cam is jammed against the transverse axle, there is surface to surface contact at the complementary curvatures.

In a preferred form of the invention, the base member comprises a longitudinal backbone member having two projecting arms, one of which has the first clamping face mounted on the free end thereof and the other of which has the clamping means, namely, the transverse axle, the spiral cam, the elongate member, and the axle lock means mounted on the free end thereof.

Advantageously, the backbone member comprises a flat bar having wide parallel sides and narrow parallel edges and in which the arms comprise parallel plates which are fastened together by spacing means so located and so spaced that the plates fit closely against the sides of the backbone member and, in which fastening means is provided to fasten the plates to the backbone member.

It is preferred that one of the arms be slidably fastened to the flat bar so that the space between the arms can be adjusted and that, in at least that arm, the spacing means comprises two offset pins spaced apart so that, when pressure is applied to the clamping face, the offset pins jam against the narrow edges of the backbone member. Advantageously, one of the spacing pins is located near the off side of the arm, that is, the side remote from the clamping face and above the near edge of the flat bar, while the other pin is located near the near edge of the arm and just below the off edge of the flat bar. Thus, when a vector is applied to the clampng face, the arm tends to rock in a mannaer such that the pins engage the edges of the flat bar, thus jamming the arm on the flat bar.

It is preferred that at least one of the narrow edges of the flat bar have serried, transverse depressions therein which are complementary in shape with the shape of the spacing pin which engages that edge.

It is preferred that the arm or arms which is adjustable be provided with arm locking means opposite one of the pins adapted to jam in the backbone member between it and the spacing pin opposed thereto. Advantageously, the arm locking means comprises a cam affixed to a transverse shaft journaled in the parallel plates, rotation of which jams the flat bar between the cam surface and the pin opposed thereto.

It will be understood that the other arm can be riveted to or otherwise affixed to the flat bar and that the particular means for slidably affixing one of the arms or both of them to the flat bar is independent of the particular means for advancing the clamping face, and vice versa.

In the preferred form of the invention, the spiral cam is located in between the two flat plates forming the arm and the transverse axle is journaled in those plates. Preferably, the locking arm means comprises a block affixed to one of the plates having a bore to receive the transverse axle and another bore normal thereto to receive the longitudinal axle which has an offset cam portion in position to jam the transverse axle on rotation thereof.

Advantageously, the spacing means for spacing the parallel plates forming the arms comprises a spacing block at the free ends thereof which holds the plates in fixed-space relation and on which a clamping face is mounted. In the preferred form of the invention, one of the faces is unitarily affixed to the block or forms a unitary part thereof and the elongate member is mounted for reciprocation in the spacing block at the free end of the other arm. Thus, in the preferred form of the invention, the parallel plates which form the arms are held in spaced relation by spacing blocks at the free ends thereof and by the two jamming pins, one of which is located on the off side in position to engage the near edge of the flat bar, and the other of which is located on the near side in position to engage the bottom edge of the flat bar.

Each of the transverse axle, the longitudinal axle and the transverse shaft have holes bored through the free ends thereof for receiving a lever arm so that they can be rotated to clamping position. Thus, when a workpiece is clamped between the clamping faces by rotation of the transverse axle and locked by rotation of the longitudinal axle and the arm or arms locked by rotation of the transverse shafts, the levers can be removed so that they do not become exposed to the high temperatures involved in processing the workpiece.

DETAILED DESCRIPTION OF THE INVENTION

Figure 4:
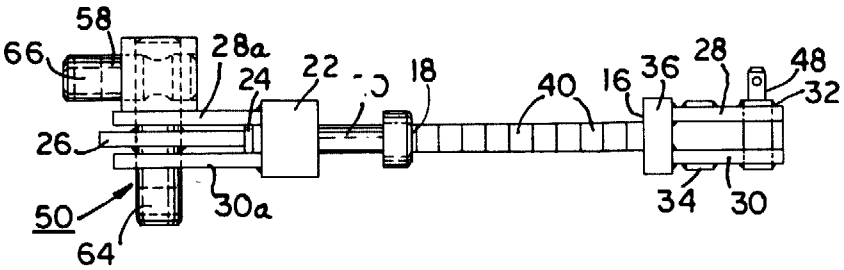
FIG. 4 is a top view of FIG. 1.
Figure 2:
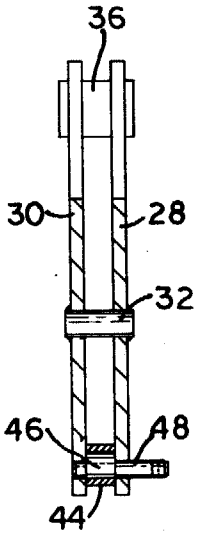
FIG. 2 is an end elevation with parts in section taken along line II—II of FIG. 1.
Figure 1:
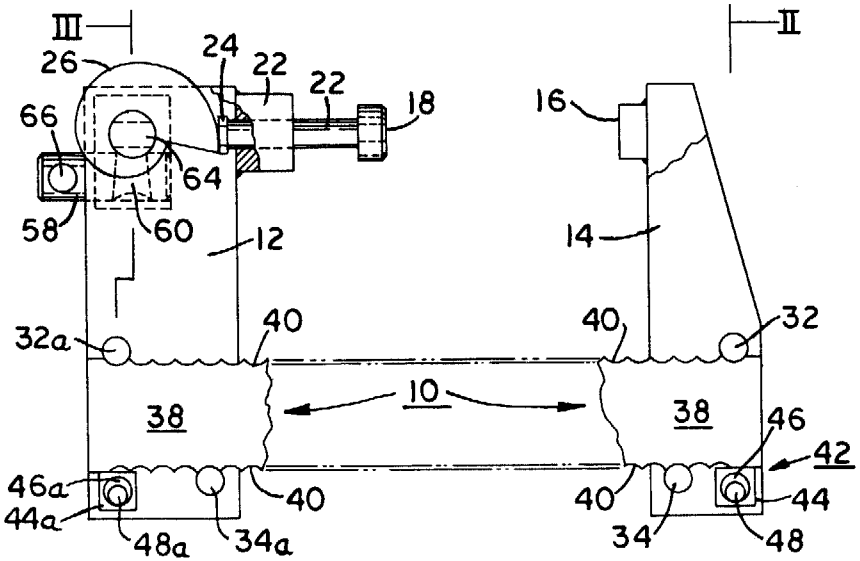
FIG. 1 is a side elevation with parts of the flat bar broken away.
Figure 3:
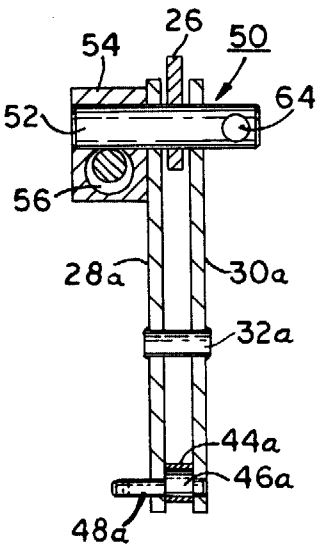
FIG. 3 is an end elevation with parts in section taken along line III—III of FIG. 1.
Figure 6:
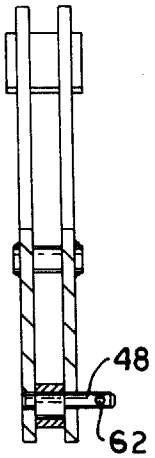
FIG. 6 is an end view of FIG. 5 in partial section taken along line VI—VI of FIG. 5.
Figure 5:
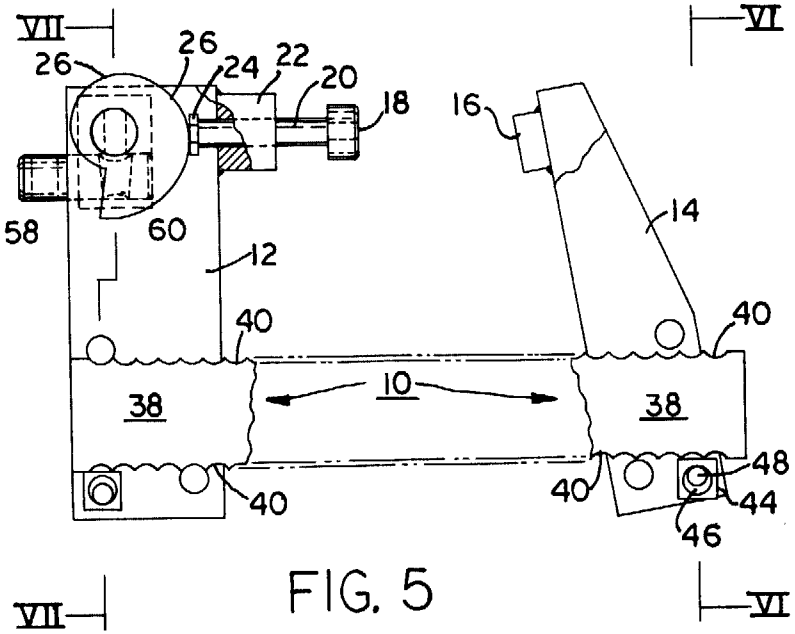
FIG. 5 is a view similar to FIG. 1, but showing the right-hand arm in release position, the axle lock in release position, and the spiral cam in a different position.
Figure 8:
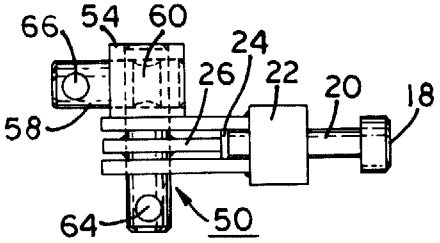
Figure 7:
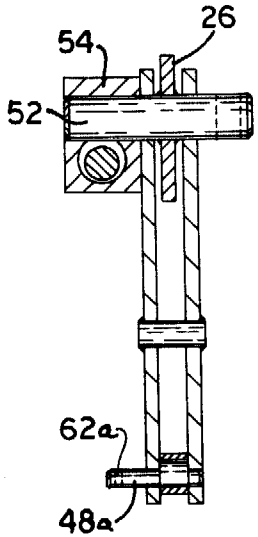
FIG. 7 is an end view of FIG. 5 taken in section along line VII—VII of FIG. 5; and, FIG. 8 is a top view of the left-hand arm of FIG. 5.

In FIG. 1 there is shown a clamp embodying the preferred form of the invention in which the base member of the clamp comprises a flat bar 10 and upstanding arms 12 and 14 having opposed clamping faces 16 and 18 affixed to the free ends thereof. The clamping face 16 is unitarily affixed to the free end of arm 14, whereas, the clamping face 18 is affixed to an elongate member 20 mounted for reciprocation in block 22 on a line with clamping face 16, so that clamping face 18 can be moved toward and away from clamping face 16. Elongate member 20 on the other end thereof has a cam follower 24 and the elongate member is caused to move toward the clamping face 16 by the spiral cam 26. Thus, when the spiral cam 26 is rotated from the position shown in FIG. 5 to that shown in FIG. 1, the elongate member 20 is pushed out toward clamping face 16. The rise is so gradual that back pressure on the face 18 will lock the arm against reverse rotation.

The arm 14 is made up of parallel plates 28 and 30 which are held in spaced relation by the spacing pins 32 and 34 and the spacing block 36 which has, on its free end, the clamping face 16. The backbone member 10 comprises a flat bar 38 having front parallel sides and narrow parallel edges. The plates 28 and 30 are spaced apart so that the flat bar 38 can slide in between them freely and the spacing pins 32 and 34 are spaced apart so that, in the position shown in FIG. 1, they engage the narrow edges of the flat bar, whereas, in the position shown in FIG. 5, at least one is lifted off of the narrow edges. This is accomplished by locating the pin 32 near the off side of the arm 14, that is, the edge remote from the clamping face 16 and locating the pin 38 near the near side, so that pins 32 and 34 are offset. Thus, in the position shown in FIG. 1, the pins 32 and 34 jam against the narrow edges of the flat bar, whereas, in the position shown in FIG. 5, they do not.

This jamming effect is enhanced by providing the narrow edges of the flat bar with serried depressions which are complementary in shape to the pins 32 and 34.

Arm locking means 43 comprises a block 44 opposed to the pin 32 having a round cam 46 mounted on shaft 48. In the position of the cam 46, shown in FIG. 1, the flat bar is clamped between the block 44 and the pin 32, whereas, in the position shown in FIG. 5, the flat bar is released so that the arm 14 can be moved back and forth on the flat bar 38.

The arm 12 is similarly mounted on the flat bar 38 by means of pins **32*a*, 34*a*, and the cam lock mechanism 44*a*, 46*a*, and 48*a***.

It will be understood that it is not necessary that both of the arms 12 and 14 be slidable on the flat bar 38 and that one or the other of them can be riveted thereto or otherwise unitarily affixed thereto. It is of advantage, however, to have them both removable because, after exposure to extreme temperatures, the flat bar 38 or one of the arms sometimes becomes warped, so that a reusable clamp is obtained simply by replacing the warped part or reversing the warped bar.

The spiral cam 26 is disposed between the plates **28*a* and 30*a* and is unitarily affixed to a transverse axle 50 which is journaled in the plates 28*a* and 30*a*. One end 52 of the transverse shaft 30 passes into a complementary bore in block 54 unitarily affixed to plate 32*a*. The block 54 has longitudinal bore 56 for receiving the longitudinal axle 58. The longitudinal axle 58 has an offset cam, the surface of which, as shown in FIG. 1, is machined to be complementary to the curvature of the axle 50. Thus, when the longitudinal axle 58 is rotated to the position shown in FIG. 1, the offset cam 60 jams against the transverse axle 50 in surface to surface contact and, when it is rotated to the position shown in FIG. 5, the transverse axle 50** is released.

The plates **28*a* and 30*a* of the arm 12 are spaced apart by the spacing pins 32*a* and 34*a* and by the spacing block 22, thus forming a unitary structure which can be fastened to the flat bar 38 by the arm lock means 44*a*, 46*a*, and 48*a*, just as the arm 42 is locked on the flat bar 38, as previously described. In operation, one or both of the arms 12 and 14 is adjusted until the workpiece is in contact with the clamping faces 16 and 18, while the spiral cam 26 is in the retracted position shown in FIG. 5**, or even farther retracted.

First, however, a lever rod, not shown, is inserted in the hole 62 and **62*a* in the transverse shaft 48 and 48*a* to rotate the the cam block 44 into the locking position shown in FIG. 1. Then, a like lever rod, not shown, is inserted in the hole 64 in the transverse shaft 50 to rotate the follower cam 26 toward the position shown in FIG. 1, thus clamping the workpiece between the clamping faces 16 and 18. When this is accomplished, the same or a like lever rod, not shown, is inserted in the hole 66 in the longitudinal axle 58 to rotate the same to the position shown in FIG. 1, to lock the spiral cam 26** in the clamped position. After the workpiece clamped in the clamp has been exposed to the temperature necessary to effect set of the metal therein, the procedure is reversed to release the workpiece.

It will be seen that the structure shown and described excellently suits the high-temperature operation and that no close tolerances, such as the threaded bolts in 'C' clamps and the like, are involved. Thus, on exposure to high temperatures, the clamp of the invention is less likely to be warped or distorted into a condition that it is not reusable.

It is to be understood that the invention is not to be limited to the exact details of operation or structure shown and described, as obvious modifications and equivalents will be apparent to one skilled in the art.

We claim:

1. In a clamp in which a clamping arm which has a clamping face on one side thereof is slidable on a flat bar having wide parallel sides and narrow parallel edges, the combination for releasably affixing said arm to said bar, in which said arm comprises parallel plates spaced apart sufficiently to closely but slidably engage the sides of said bar with the ends thereof extending beyond the bottom edge of said bar and having a first transverse spacing pin adjacent one side of said arm adapted to rest on one narrow edge of said bar;

a second transverse spacing pin adjacent the other side of said arm and adapted to engage said other narrow edge of said bar;

cam lock means adapted to engage said other narrow edge of said bar directly opposite said first transverse spacing pin; and, actuating means for actuating said cam lock means to and from locking position, in which locking position said bar is jammed between said first transverse spacing pin and said cam lock means independently of said clamping face, in which at least the other of said narrow edges has serried detents therein which are complementary to the second transverse pin adapted to engage that edge and in which said cam lock means comprises a flat surface adapted to abut said other narrow edge and having a longitudinal span greater than that of any of said serried detents.

2. A clamp of claim 1, in which said actuating means comprises a removable lever which is removed after the clamp is set and in which all other components of said clamp are composed of high-temperature-resistant steel, whereby, after the clamp is set and the lever removed, the clamp and the workpiece clamped therein can be exposed to high temperatures.

* * * * *